United States Patent [19]

Hollingshead

[11] 4,080,091

[45] Mar. 21, 1978

[54] DRILL BIT

[75] Inventor: Frank A. Hollingshead, Houston, Tex.

[73] Assignee: Reed Tool Company, Houston, Tex.

[21] Appl. No.: 738,413

[22] Filed: Nov. 3, 1976

[51] Int. Cl.[2] ..... B23B 51/06

[52] U.S. Cl. ..... 408/60; 175/340; 239/600; 285/404

[58] Field of Search ..... 408/57, 59, 60, 61; 175/339, 340, 393; 285/404; 239/600

[56] References Cited

U.S. PATENT DOCUMENTS

| | | | |
|---|---|---|---|
| 3,329,222 | 7/1967 | Neilson | 175/340 |
| 3,447,755 | 6/1969 | Cartwright | 239/600 |
| 3,521,911 | 7/1970 | Hanes et al. | 285/27 |
| 3,685,601 | 8/1972 | Hollingshead | 175/340 |

*Primary Examiner*—Leonidas Vlachos
*Attorney, Agent, or Firm*—Neal J. Mosely

[57] ABSTRACT

A rotary drill bit having a plurality of journal-mounted rotating cutters and jet passageways through which drilling fluid is discharged between the cutters is provided with removable nozzles for air or other drilling fluid. The nozzles are provided with a peripheral groove and secured in place in said passageways by the divided ends of a bifurcated retaining pin.

5 Claims, 3 Drawing Figures

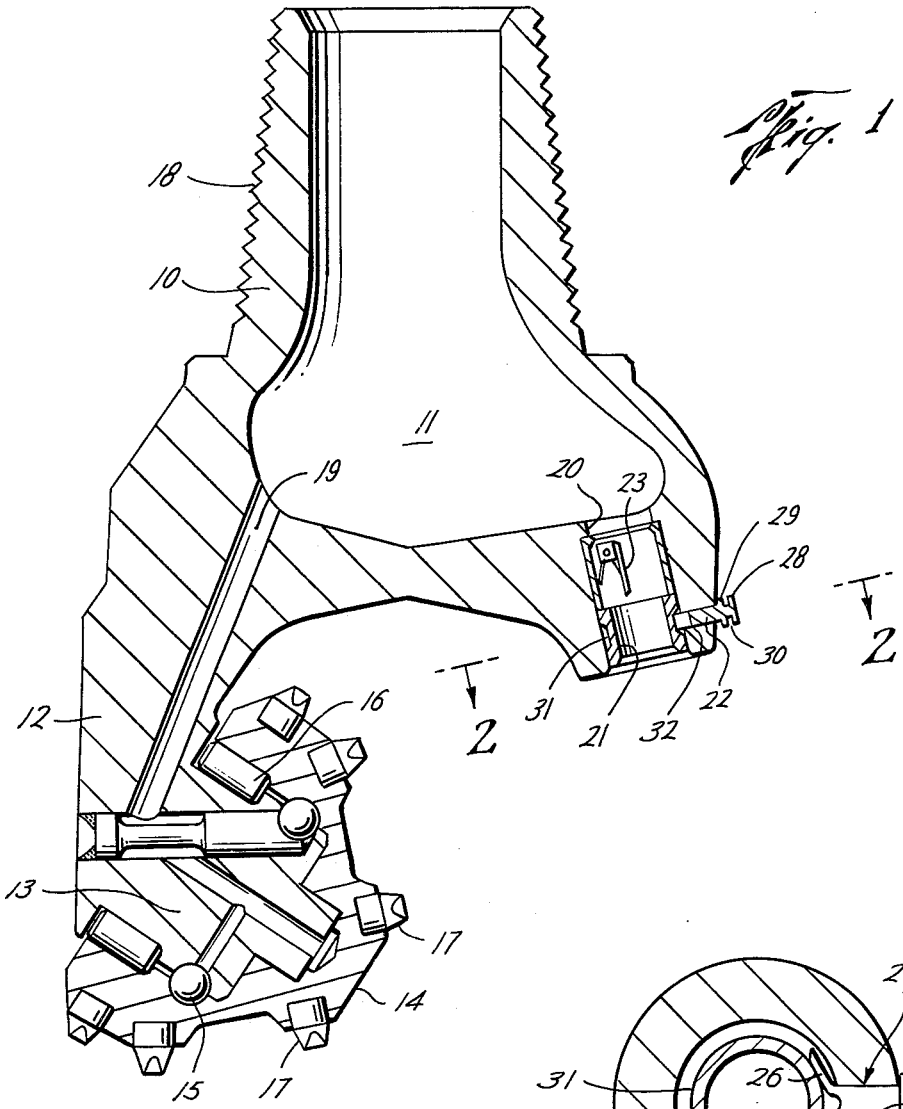
Fig. 1
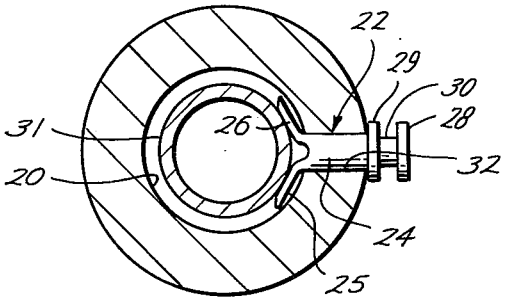
Fig. 2
Fig. 3
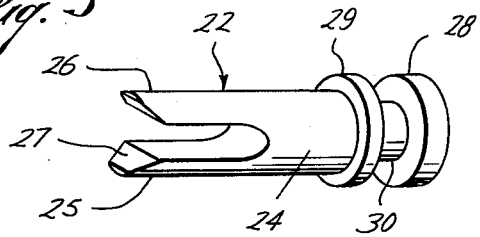

DRILL BIT

BACKGROUND OF THE INVENTION

1. Field of the Invention

This invention relates to improved designs for rotary drill bits having removable nozzles for air or other drilling fluid and more particularly to a means for retaining said fluid nozzle in place.

2. Brief Description of the Prior Art

The placement of one or more passageways in a rotary drilling bit to conduct air or other drilling fluids from the central bore of the bit to the rotating cutters is well known. The drilling fluid thus directed serves to cool the cutters and to carry cuttings away from the cutters. However, the presence of these passageways makes it possible for cuttings and other foreign materials to enter the interior of the bit when the circulation of the drilling fluid ceases and thus to impair the further operation of the bit. This problem has been dealt with by placing check valves or filters in the interior bore passageways of rotary drill bits. For example, Nickles U.S. Pat. No. 3,198,269 discloses a single passageway leading from the interior bore of the bit to the space directly above the rotary cutters. A spring loaded check valve is placed in the interior bore and in the single passageway and serves as a nozzle to direct drilling fluid between the cutters and also serves to prevent reverse flow through the passageway into the interior bore. The check valve is removable through the top of the bit when it is disconnected from the drill string.

The check valve assembly in the drill bit disclosed in the Nickles patent is removable from the bit only through the top thereof, thus necessitating the detachment of the drill bit from the drill string in order to remove the check valve assembly. Furthermore, the Nickles bit provides for only one passageway to direct drilling fluid between the bits and thus does not permit the application of a stream of drilling fluid at multiple points on the cutter. In applicant's prior U.S. Pat. No. 3,685,601, there is disclosed an improvement in drill bits in which there are provided a plurality of passageways for discharging air or other drilling fluid between the cutters and each passageway having a nozzle or check valve assembly removably positioned therein. In this construction, the nozzle or check valve is removably secured in place by means of a set screw. There is some disadvantage to the use of a set screw in this arrangement since the set screw may come loose during operation and allow the air nozzle or check valve assembly to fall out.

Moore U.S. Pat. No. 3,744,581 discloses a different type of fluid nozzle for roller cutter drill bits which is removably positioned and secured by a check valve and sealed by a peripheral 0-ring. The use of a set screw in this type of nozzle is subject to the same disadvantage mentioned above.

Scarborough U.S. Pat. No. 3,084,751 discloses an air nozzle for rotary cutter drill bits which is held in place by a thick wire having a head somewhat like a nail for ease of removal. The retaining wire or rod is inserted into matching grooves in the outside of the nozzle member and the inside of the passageway in which the nozzle member is fitted. This arrangement has the slight disadvantage that it is necessary to have an extra groove machined or cut in the passageway in which the nozzle is positioned. This cutting or machining operation adds to the expense of manufacture of the drill bit.

Mori U.S. Pat. No. 3,220,754 discloses a removable air or other drilling fluid nozzle in a drag type bit. The nozzle is constructed similarly to that of Scarborough and is held in place by a retaining rod inserted into a groove cut on only one side of the nozzle and aligned with a matching groove in the passageway in which the nozzle is fitted. This arrangement is complicated to manufacture and is difficult both in assembly and in disassembly.

SUMMARY OF THE INVENTION

This invention relates to new and useful improvements in rotary drill bits. The invention provides for a drill bit having a body with a plurality of arms extending therefrom, each arm having a bearing shaft for supporting a rotary cutter mounted thereon. The body defines a central recess; a plurality of cooling passageways extend through the body from the central recess to the bearing shafts and a plurality of jet passageways extend through the body from the central recess to discharge air or other drilling fluid between adjacent cutters. Flow control means, such as fluid nozzles or check valves, are placed in each of these jet passageways so that flow of drilling fluid from the central recess and between the cutters is allowed, but flow from outside the body of the bit, through the jet passageways, and into the central recess is prevented. The flow control means serves as a nozzle to direct flow between the cutters as desired. The nozzles are removably positioned in the jet passageways and held in place by the split ends of a bifurcated pin member. The retaining pin member has a head similar to that of a nail for ease of removal for releasing the nozzle for replacement or repair.

One of the objects of this invention is to provide an improved rotary drill bit with multiple passageways extending through the body of the bit to facilitate the direction of multiple streams of drilling fluid onto the cutters as desired and having removable fluid directing nozzles positioned therein retained in place by easily removable retaining pins.

Another object of this invention is to provide a rotary drill bit having a plurality of passageways for directing multiple streams of drilling fluid onto the cutters thereof and each provided with a fluid directing nozzle removably positioned therein and retained in place by a retaining pin having a head positioned external to the bit for ease of removal.

Another object of this invention is to provide an improved rotary drill bit having one or more removable, fluid directing nozzles positioned for directing streams of fluid onto the cutters and having bifurcated pin members securing said nozzles in position.

Other objects of this invention will become apparent from time to time throughout the specification and claims as hereinafter related.

BRIEF DESCRIPTION OF THE DRAWINGS

FIG. 1 is a view partly in elevation and partly in section on the center line showing a rotary drill bit embodying the improved removable nozzle and retaining means of the subject invention, FIG. 2 is a section view taken on the line 2—2 of FIG. 1 showing the relationship of the retaining pin to the fluid directing nozzle, and FIG. 3 is an isometric detail view of the retaining pin for the air nozzle, also shown in FIGS. 1 and 2.

DESCRIPTION OF THE PREFERRED EMBODIMENT

FIG. 1 discloses the principle features of a rotary drill bit embodying the subject invention. FIG. 1 is a longitudinal sectional view of the bit and so only one of the rotary cutters is shown of the three cutters normally constituting the bit structure. The body 10 of the drill bit defines a centrally located recess 11 and has three arms 12 (only one of which is shown) depending therefrom. Each of the arms 12 has a shaft 13 with a rotary cutter 14 supported thereon in the usual manner with the aid of ball bearings 15 and roller bearings 16. The cutter is shown with a plurality of tungsten carbide cutting inserts 17, although a tooth type cutter could be used equally well. The drill bit body 10 is threaded as shown at 18 for connection to a drill string (not shown).

Cooling passageways 19 extend through the body 10 from the central recess 11 to the recesses between the bearing shafts 13 and cutters 14, whereby relatively cool air or other drilling fluid may be introduced to cool the bearing shafts and cutters as they become heated in the drilling operation. Jet passageways 20 extend through the body 10 from the central recess 11 and are arranged to discharge air between the exterior surfaces of the cutters 14 whereby cuttings and other foreign matter are carried away from the cutters.

A nozzle 21 for air or other drilling fluid is secured in the lower portion of each jet passageway 20 by removable retaining pin 22. The air nozzle 21 is preferably one having a spring loaded check valve 23 of a type shown and claimed in applicant's U.S. Pat. No. 3,685,601. The retaining pin 22, which is an essential novel feature of this invention is preferably used in conjunction with a check valve-air nozle of the type shown. However, this retaining pin arrangement can be used to hold other drilling fluid nozzles in position such as the nozzles illustrated in U.S. Pat. Nos. 3,084,751 and 3,744,581. The check valve 23 in nozzle 21 prevents the introduction of cuttings and other damaging foreign matter into the central recess 11, the cooling passages 19, the area between the shafts and the cutters, and other interior parts of the bit when the air flow therethrough is discontinued.

The details of the retaining pin 22 and the use of the retaining pin in securing nozzle 21 in place are shown in FIGS. 2 and 3. Retaining pin 22 has a solid body portion 24 with a bifurcated end portion having legs 25 and 26 which are tapered as indicated at 27. The opposite end of the retaining pin 22 has enlarged head portions 28 and 29 separated by a peripheral groove 30.

The air nozzle 21 has a peripheral groove 31 which is positioned opposite a passageway 32 through the side of body 10 extending into passageway 20. When nozzle 21 is inserted into passageway 20, the peripheral groove 31 is aligned with passageway 32. The retaining pin 22 is then placed into passageway 32 and driven into place by a hammer or the like. When pin 22 is driven against the edge of nozzle 21 the beveled end portions 27 of the bifurcated end of pin 22 separated and are driven into groove 31 between the bottom edge of the groove and the surface of the passageway 20, as seen in FIG. 2. When the pin 22 is driven into place, as shown in FIG. 2, the head portion 29 abuts the outer surface of the bit and limits the further penetration of the retaining pin.

The retaining pin 22 is left in the position shown during normal operation of the drill bit. When it is desired to repair or replace the nozzle member 21, pin 22 may be removed by application of any suitable tool, such as pliers or a claw hammer, to the groove 30 at the head of the pin to pull the same out of retaining position and release the nozzle for removal.

It will be appreciated that the nozzles shown can be easily secured in the jet passageways of many standard rotary drill bits without modification of such bits. The retaining pin 22 cooperates with the groove 31 and the nozzle 21 to retain the nozzle in position and does not require the machining or cutting of a further groove in the passageway 20 as is required in the case of certain prior art drill nozzles.

The nozzles may be serviced or replaced as necessary with great ease and efficiency and without danger of the retaining pin coming loose and allowing the nozzle to fall out. When the nozzle used is a check valve type nozzle, as shown, it is apparent that these nozzles afford a minimum opportunity for failure and that the nozzles are positioned to direct the air betwen the exterior surfaces of the cutters as desired and exclude the entry of foreign matter into the interior recesses and passageways of the drill bit.

I claim:

1. A rotary drill bit, comprising
   - a body,
   - a plurality of rotary cutters,
   - means for rotatively mounting said cutters on said body,
   - said body defining a plurality of first passageways,
   - a hollow tubular fluid-directing nozzle positioned in each of said first passageways,
   - each nozzle having peripheral groove in its outer surface,
   - said body having a plurality of second passageways,
   - each of said second passageways intersecting only one of said first passageways, and
   - a bifurcated retaining pin for each nozzle having a solid stem portion in said second passageway and having its ends spread and inserted into said groove to secure the nozzle in its passageway.

2. The rotary bit of claim 1 in which each pin has an enlarged head portion on said stem portion to be gripped by a tool for removal.

3. The rotary bit of claim 2 in which each pin has a pair of enlarged head portions separated by a peripheral groove.

4. The rotary bit of claim 1 in which each nozzle has a check valve therein operable to permit fluid to flow through each of said passageways out of said bit body.

5. The rotary bit of claim 4 in which each of said check valve nozzles includes a pivoting plate adapted to close said passageway and a spring urging said plate toward its closed position.

* * * * *